US006938366B2

(12) United States Patent
Bober et al.

(10) Patent No.: US 6,938,366 B2
(45) Date of Patent: Sep. 6, 2005

(54) SELF-ERECTING DEVICE WITH DEBRIS COLLECTING FEATURE

(75) Inventors: Andrew M. Bober, Racine, WI (US); Keith J. Bradley, Racine, WI (US); Dan S. Rocque, Racine, WI (US)

(73) Assignee: JohnsonDiversey, Inc., Sturtevant, WI (US)

( * ) Notice: Subject to any disclaimer, the term of this patent is extended or adjusted under 35 U.S.C. 154(b) by 0 days.

(21) Appl. No.: 10/707,367

(22) Filed: Dec. 9, 2003

(65) Prior Publication Data

US 2005/0066562 A1 Mar. 31, 2005

Related U.S. Application Data

(63) Continuation-in-part of application No. 10/249,932, filed on May 20, 2003.

(51) Int. Cl.[7] ..... G09F 15/00
(52) U.S. Cl. ..... 40/610; 116/63 R
(58) Field of Search ..... 40/610, 612; 116/63 C, 116/63 R; 141/390

(56) References Cited

U.S. PATENT DOCUMENTS

| | | | | |
|---|---|---|---|---|
| 2,047,748 A | | 7/1936 | Schmidt | 46/21 |
| 2,762,327 A | | 9/1956 | Weig | 116/63 |
| 2,800,099 A | * | 7/1957 | Baker | 116/63 R |
| 2,808,803 A | * | 10/1957 | Weig | 116/63 R |
| 2,881,662 A | | 4/1959 | Harris | 88/79 |
| 3,113,551 A | | 12/1963 | Korn | 116/63 |
| 3,250,241 A | | 5/1966 | Levy et al. | 116/63 |
| 3,707,320 A | | 12/1972 | Brynes | 350/97 |
| 3,720,181 A | | 3/1973 | Elkins | 116/63 |
| 3,892,081 A | | 7/1975 | Goral | 40/214 |
| 4,884,603 A | | 12/1989 | Simpson | 141/390 |
| 4,929,214 A | | 5/1990 | Liebermann | 446/221 |
| 5,149,028 A | | 9/1992 | Blackaby et al. | 248/101 |
| 5,270,089 A | | 12/1993 | Alston et al. | 428/60 |
| 5,316,060 A | | 5/1994 | Hodgdon et al. | 141/390 |
| 5,506,040 A | | 4/1996 | Cordani | 428/218 |
| 5,549,945 A | | 8/1996 | Lind | 428/35.5 |
| 5,597,418 A | | 1/1997 | Evans, Jr. et al. | 134/6 |
| 5,834,104 A | | 11/1998 | Cordani | 428/218 |
| 5,941,752 A | | 8/1999 | Liebermann | 446/220 |
| 2002/0110289 A1 | | 8/2002 | Fishman et al. | 383/33 |
| 2004/0231214 A1 | | 11/2004 | Bober et al. | 40/610 |

FOREIGN PATENT DOCUMENTS

| | | | |
|---|---|---|---|
| JP | 2003064626 | 5/2003 | E01F/9/00 |
| WO | WO 2000/104302 | 12/2004 | E01F/9/012 |

* cited by examiner

*Primary Examiner*—Lars A. Olson
(74) *Attorney, Agent, or Firm*—Neil E. Hamilton; James J. Sales; Renee J. Rymarz

(57) ABSTRACT

A self-erecting device which can serve as a signaling unit as well as a debris collection unit. The signaling unit provides a chamber for debris and has an opening for the collection of debris therein. A base member has a beveled edge to facilitate the collection of debris into the chamber. The self-erecting and debris collection device is simple in construction and easy to operate.

22 Claims, 8 Drawing Sheets

SELF-ERECTING DEVICE WITH DEBRIS COLLECTING FEATURE

BACKGROUND OF INVENTION

Technical Field

This invention relates to a self-erecting signal device. More particularly, it relates to a self-erecting signal device which is particularly suited for signaling spills or spots on floors so as to serve as a warning as well as a receptacle for debris.

Inflatable signaling devices are well-known. These are disclosed in U.S. Pat. Nos. 2,762,327; 3,113,551; 3,250,241; 3,707,320; 3,720,181 and 3,892,081.

Self-inflatable enclosures are disclosed in U.S. Pat. Nos. 4,929,214 and 5,941,752.

U.S. Pat. No. 2,881,662 discloses a warning sign having an opening for receiving objects.

Fluid absorbing mats are disclosed in U.S. Pat. Nos. 5,270,089; 5,506,040; 5,549,945; 5,597,418 and 5,834,104.

The prior art does not provide a self-erecting signaling device. Neither does it provide a self-erecting signaling device which is adaptable to for use with a liquid absorbing mat as well as provide a receptacle for debris.

There is a need for a self-erecting signaling device to indicate spills on a floor. These occur frequently in stores and other public places and particularly those which provide products which when dropped on a floor result in a liquid or slippery substance. This is a hazardous condition for shoppers and pedestrians, as falls can occur. Not only is a self-erecting signaling device beneficial, it is even more useful if it is combined with an absorbing material which can absorb the spilled material as well as provide a receptacle for debris.

The objects of the invention therefore are:

a) Providing a self-erecting signaling device.

b) Providing a self-erecting signaling device which is easily activated.

c) Providing a self-erecting signaling device of the foregoing type which is simple in construction and economical to produce.

d) Providing a self-erecting signaling device of the foregoing type which includes a fluid absorbing feature.

e) Providing a self-erecting signaling device of the foregoing type which can also include a receptacle for debris.

Providing a self-erecting signaling device of the foregoing type which facilitates the collection of debris and disposal thereof.

SUMMARY OF INVENTION

The foregoing objects are accomplished and the shortcomings of the prior art are overcome by the self-erecting and debris collecting device of the invention which in one embodiment includes a base member constructed to rest on a surface and a gas generating member. An inflatable member is in fluid communication with the gas generating element and a signal member is erected by the inflatable member. The signal member is constructed and arranged to provide a receptacle for debris.

In another embodiment, the inflatable member is in the signal member and the signal member is connected to the inflatable member.

In a preferred embodiment, the receptacle includes an opening extending over a portion of the base member.

In another preferred embodiment, the base member includes a beveled edge positioned adjacent the opening.

In another aspect, the invention provides a self-erecting and debris collecting device which includes a signal member, the signal member constructed and arranged to provide a receptacle for debris. An inflatable member is connected to the signal member. The inflatable member is constructed and arranged to be inflated by a self-contained expandable member. A base member is connected to the inflatable member.

In yet another aspect, the base member includes an absorbent member constructed and arranged to absorb liquid and spills on a surface.

These and still other objects and advantages of the invention will be apparent from the description which follows. In the detailed description below, a preferred embodiment of the invention will be described in reference to the full scope of the invention. Rather, the invention may be employed in other embodiments.

DETAILED DESCRIPTION

Figure 1:
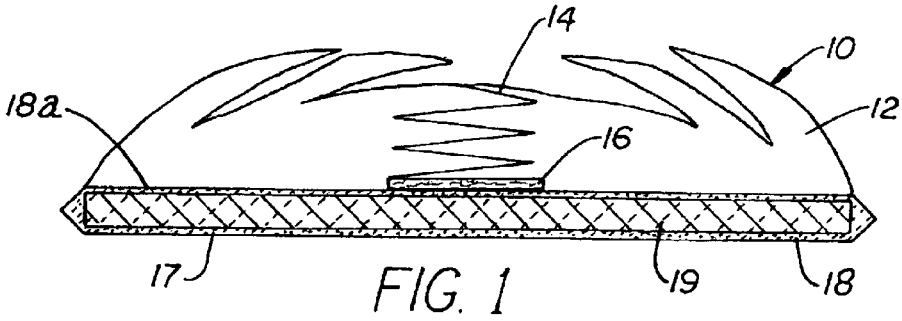
FIG. 1 is a side view of the self-erecting device of this invention.

Referring to FIG. 1, the self-erecting device of this invention generally 10 includes a flexible signal element or member 12 attached to a base member 17. Signal member 12 is composed of a plastic sheet which is preferably high density polyethylene. It is a flexible, expandable, pyramidal blanket which overlies the base member 17. It is of a pyramidal configuration when inflated. An inflatable member 14 is connected to the signal member 12 as well as the base member 17. Base member includes a lower fabric covering 18 and an upper fabric covering 18*a*. The lower fabric covering 18 and upper fabric covering 18*a* are composed of a nonwoven fabric comprised of 75% PET and 25% cellulose, Grade 12124 from Ahlstrom Fiber Composites. An absorbent core layer 19 is composed of a cellulose/super absorbent polymer composite core material from Gelok International Corp. as Gelok(r) 500/50 composite. It is entrapped in the nonwoven matrix of the fabric coverings 18 and 18*a*.

Figure 1A:
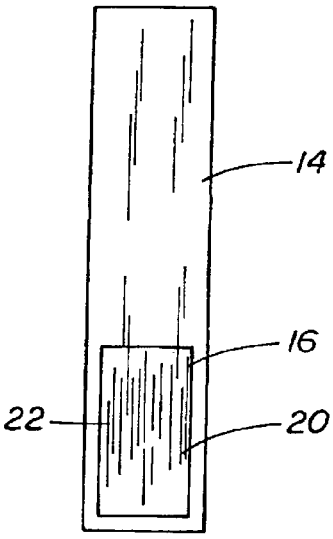
FIG. 1A is a side view of an inflatable member employed in the self-erecting device of FIG. 1.
Figure 1B:
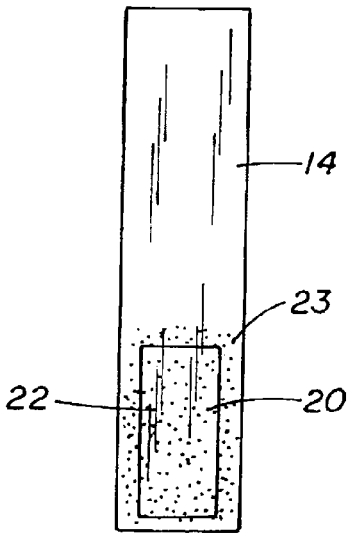
FIG. 1B is a view similar to FIG. 1A illustrating the activation of the inflatable member.

An expandable member 16 is placed inside the inflatable member 14. This is seen in FIGS. 1A and 1B. The inflatable member 14 is of a tubular configuration and contains two sachets 20 and 22. The inflatable member 14 is composed of a flexible polypropylene gas impervious plastic material as are the sachets 20 and 22. In the instance of the sachets, they contain components which when mixed together produce a gas. For example, sachet 22 can contain a carbonate or bicarbonate powder and sachet 20 an acid solution such as citric. These sachets 20 and 22 are constructed so they are breachable when a force is imposed so as to result in a mixing of the acid with the powder and produce carbon dioxide gas and provide an expandable member 16. This gas generating system is indicated in FIG. 1B with the carbon dioxide being indicated at 23.

Figure 2:
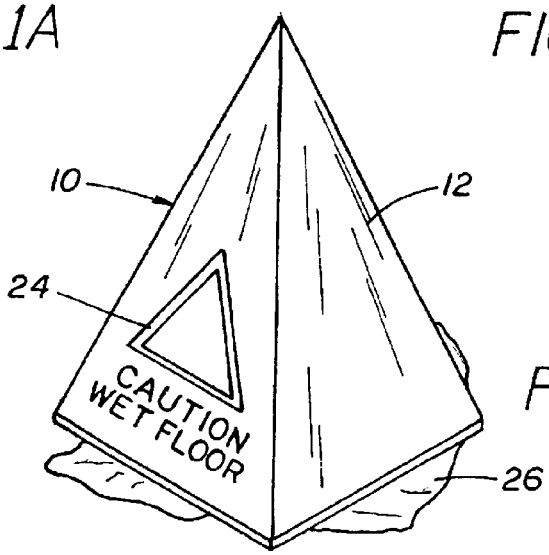
FIG. 2 is a perspective view of the self-erecting device of FIG. 1 in the erected state.
Figure 3:
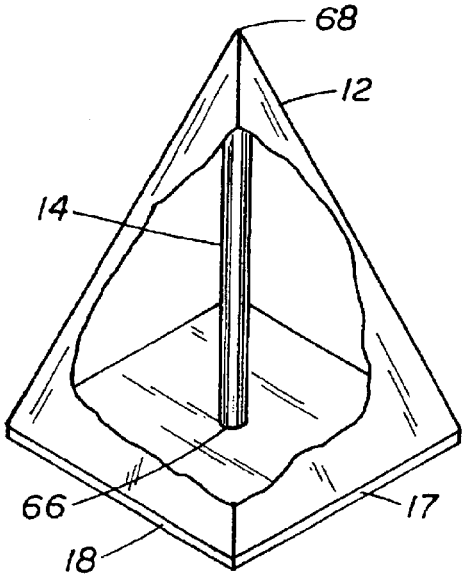
FIG. 3 is a view similar to FIG. 2 with a portion broken away to show the inflatable member.

In the following embodiments of FIGS. 4–9, the same parts are indicated with the same numbers as indicated in FIGS. 1–3.

Figure 4:
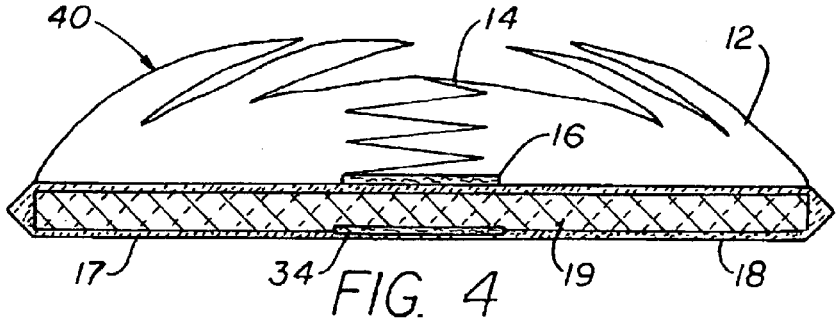
FIG. 4 is a view similar to FIG. 1 showing an alternative embodiment.

The FIG. 4 embodiment generally 40 is similar to embodiment 10 except that it additionally includes a frangible pad 34 which contains a carpet stain remover or a remover of stains on hard floors such as stone or terrazzo. The preferred stain remover is specific for the type of stain, either water-borne or oily. For water-borne spots and stains, the preferred stain remover is a 1% solution of sodium lauryl sulfate in water. For oily stains, the preferred stain remover is mineral spirits. The pad would be composed of a material similar to the sachets 20 and 22.

Figure 6:
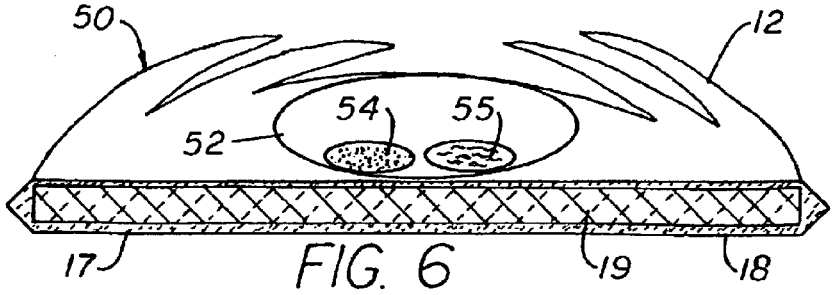
FIG. 6 is a view similar to FIG. 1 showing another embodiment.
Figure 7:
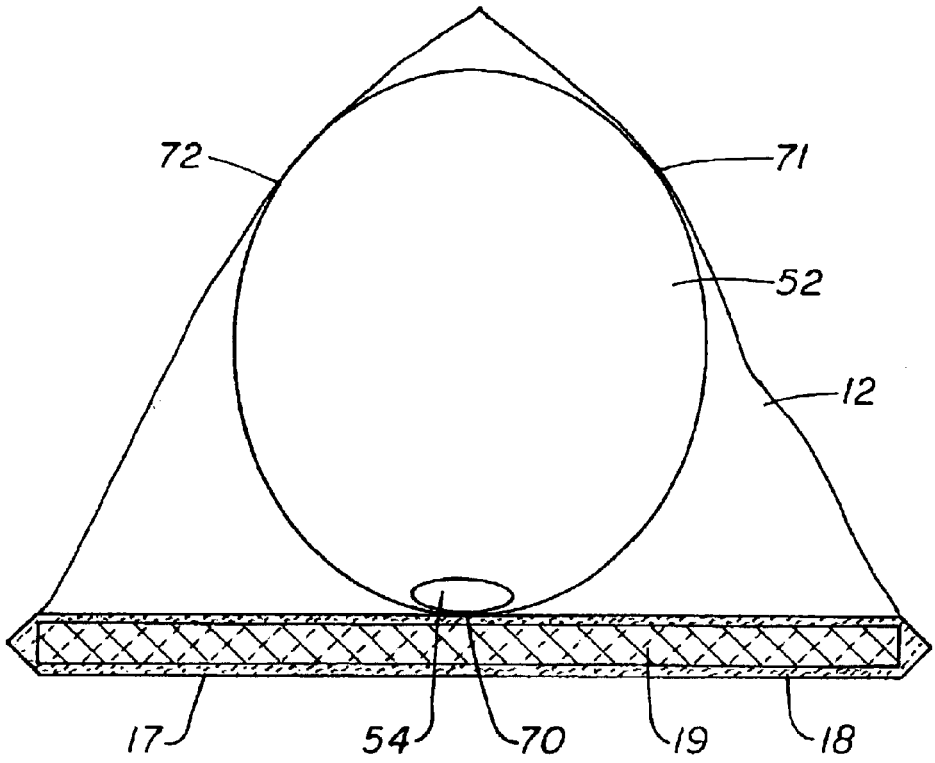
FIG. 7 is a view similar to FIG. 3 showing the FIG. 6 embodiment in an erected state.

FIG. 6 illustrates still another embodiment generally 50. In place of the previously described tubular inflatable member 14, there is a latex balloon 52 containing frangible sachets 54 and 55 which contain the previously described acid and powder.

Figure 8:
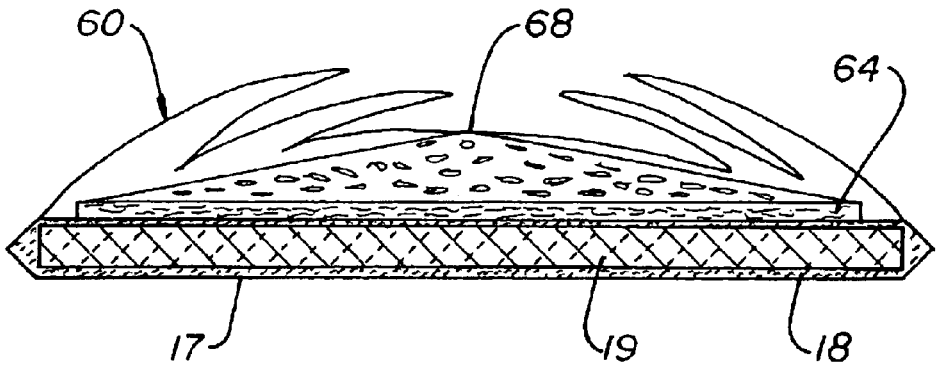
FIG. 8 is a view similar to FIG. 1 showing another embodiment.
Figure 9:
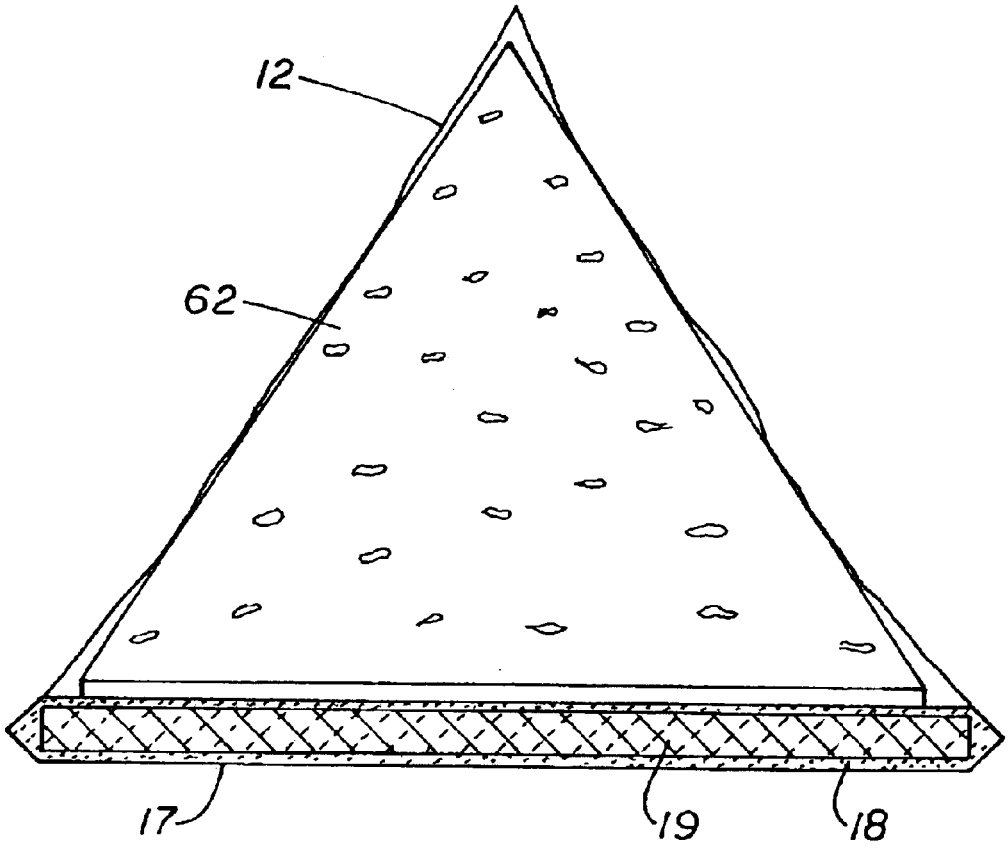
FIG. 9 is a view similar to FIG. 3 showing the FIG. 8 embodiment in an erected state.

FIG. 8 shows yet another embodiment generally 60. In place of the previously described tubular inflatable member 14 and the balloon 52, there is a sponge 62 with a frangible water sachet 64.

Figure 10:
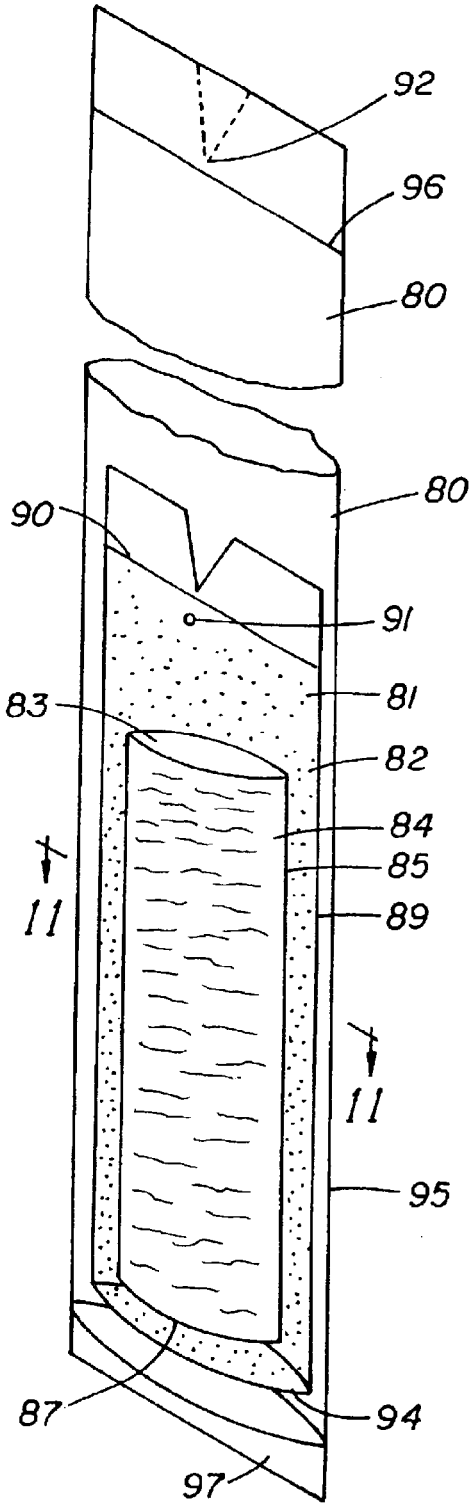
FIG. 10 is a view similar to FIGS. 1A and 1B showing a preferred embodiment.
Figure 11:
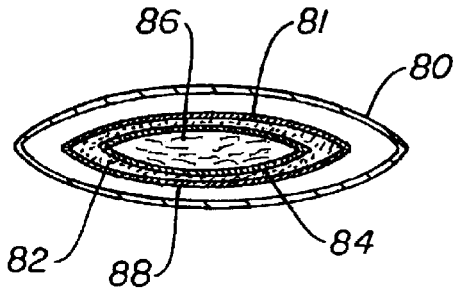
FIG. 11 is a sectional view taken along line 11—11 of FIG. 10.

FIGS. 10 and 11 illustrate a preferred inflatable member 80 and expandable member 81. In this instance, there is an inner sachet 84 containing water 86 and the outer expandable member 81 providing a compartment or sachet 82 for a powder 88 composed of sodium bisulfate and sodium carbonate. A pin hole 91 is located at one end of the sachet 82 for the purpose as later explained in the Operation. A precut or preweakened portion 92 is provided in the inflatable member 80 the purpose of which will also be later explained.

The preferred material for fabricating the inflatable member 80 is polypropylene. The expandable member 81 or sachet 82 is composed of high density polyethylene and sachet 84 is composed of low density polyethylene.

In a preferred manner, sachet 84 is heat sealed along its edges such as at 83 and 85 as well as at 87 where it is in turn sealed to sachet 82. It will be recognized that in the instance of seals 83 and 84, they are designed so that sachet 84 can be broken with hand or foot force to allow water 86 to escape and mix with powder 88. Sachet 82 is in a like manner sealed in a tubular manner along edges 89 and 90 as well as at 94 where it is sealed to sachet 84 as well as inflatable member 80. It will be seen that the inflatable member 80 is in turn sealed in tubular manner along its edges 95, 96 and 97.

Inflatable member 80 is heat sealed to the outer member 12 at its opposing ends such as along seals 96 and 97.

It will be recognized that inflatable member 14 as well as sachets 20 and 22 are sealed in a tubular manner such as previously described for inflatable member 80 and sachets 82 and 84. It is not necessary for the sachets 20 and 22 to be connected to the inflatable member 14.

Figure 12:
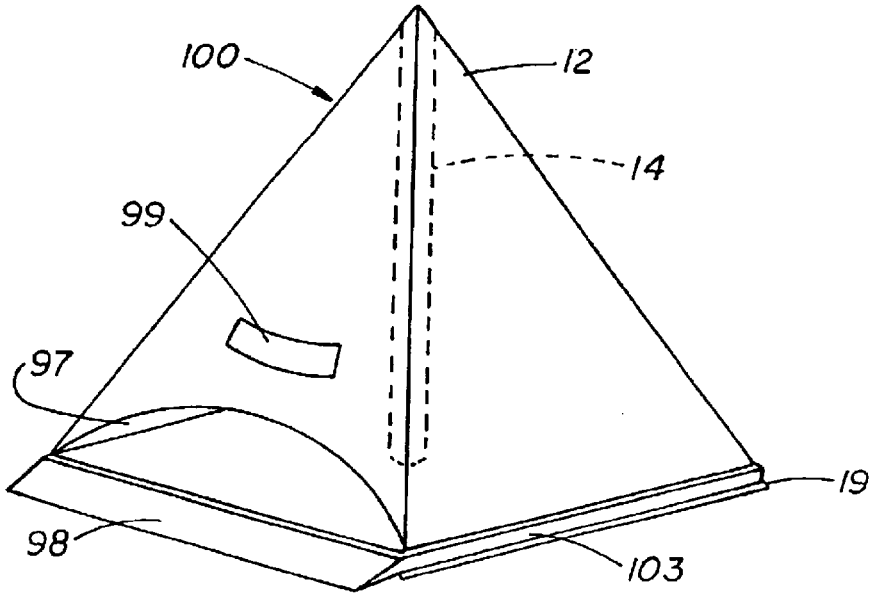
FIG. 12 is a view similar to FIG. 3 showing yet another preferred embodiment.

The FIG. 12 embodiment generally 100 incorporates the same basic components as described in FIGS. 1–3 for self-erecting device 10. It has the signal member 12 supported by the inflatable member 14 as well as the base member 17. The difference between the previously described embodiments and that of FIG. 12 is the opening 97 extending over a portion of the base member 17 and a beveled edge or lip 98 adjacent the opening 97. There is also a handle 99. The purpose of the opening 97, the lip 98 and the handle 99 are described later in the Operation.

Figure 15:
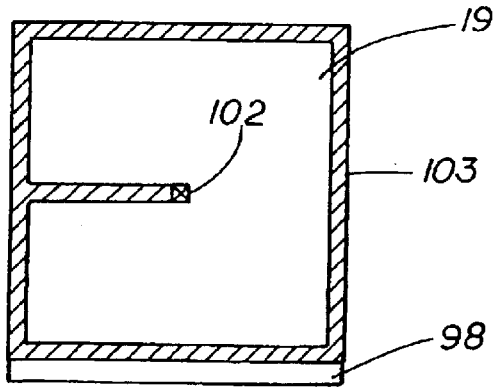
FIG. 15 is a horizontal sectional view of the device shown in FIG. 12.
Figure 14:
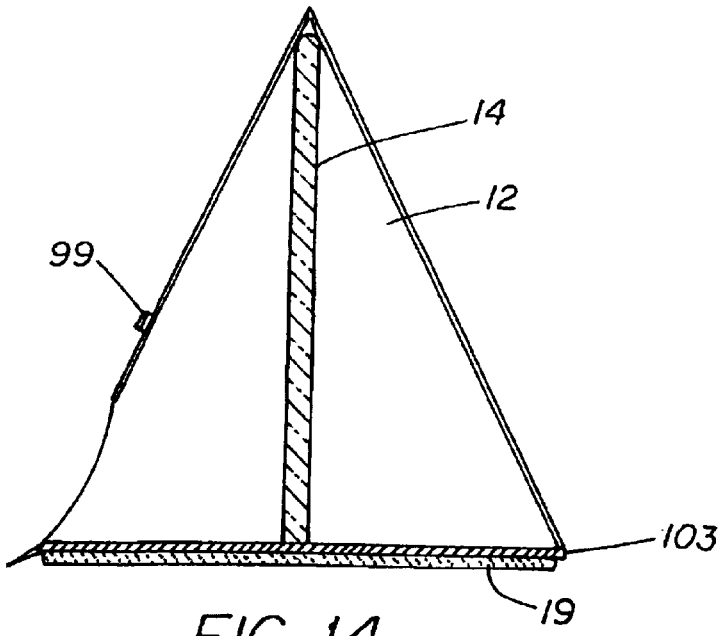
FIG. 14 is a vertical sectional view of the device shown in FIG. 13.

Referring to FIGS. 14 and 15, the base member 17 includes the absorbent pad 19 and a generally rectangular support 103. There is an intermediate arm portion 101 which forms a part of the support 103. This serves as a base support for the inflatable member 14 such as at 102. Support 103 and lip 98 are of a one piece construction and preferably composed of a plastic material such as polyvinyl chloride. They are secured to pad 19 as well as to signal member 12 such as by a hot melt adhesive.

Figure 16:
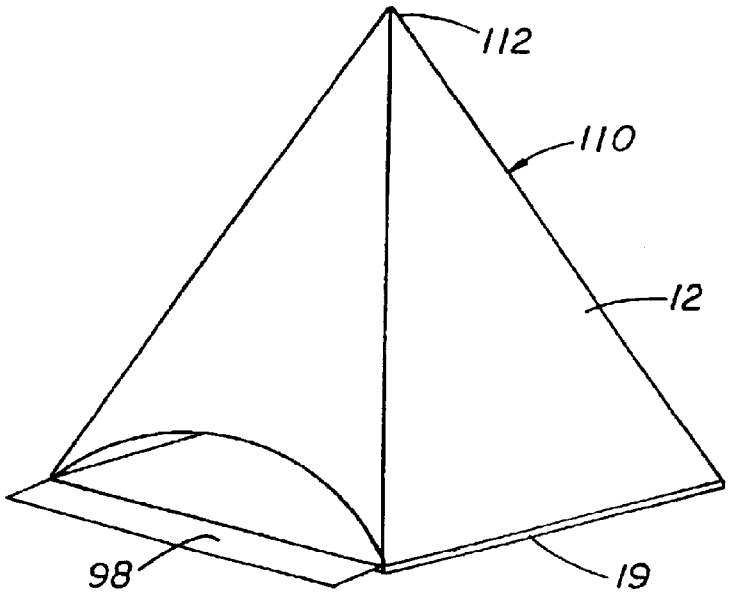
FIG. 16 is a view similar to FIG. 3 showing still another preferred embodiment.
Figure 17:
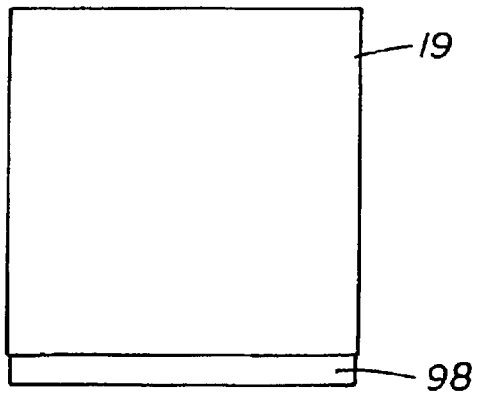
FIG. 17 is a horizontal sectional view of the device shown in FIG. 16.

The FIG. 16 embodiment generally 110 is similar to embodiment 100. It includes the inflatable member 14 (not shown). However, it does not employ the support 103. Instead, the lip 98 is connected directly to the absorbent core 19. Further, the handle 99 provided in embodiment 100 is eliminated, as the signal member 12 can be effectively grasped and folded without it. Lip 98 is secured directly to core or mat 19 such as by a hot melt adhesive.

Operation

A better understanding of the self-erecting devices of the invention will be had by a description of their operation. Referring to embodiment 10, it will be supplied in a collapsed condition as shown in FIG. 1. When a liquid spill is detected as indicated at 26 in FIG. 2, self-erecting device 10 is placed over the spill 26 and a force exerted on it such as by a foot. The force should be sufficient to fracture the sachets 20 and 22 and cause the citric acid solution and the carbonate powder to react. This is depicted in FIG. 1B with the carbon dioxide gas 23 evolving. As the gas evolves, it fills tubular inflatable member 14 causing it to rise and assume a pyramidal position as shown in FIG. 3. The inflatable member 14 functions in a manner similar to the center pole in a tent. It is connected centrally to base member 17 such as at 66 and at the inside of peak or apex 68 of the erected outer member 12. When placed over spill 26 in the erected position as seen in FIG. 2, it will serve as a warning device with the indicia 24. At the same time, the absorbent layer 19 in base member 17 absorbs the liquid spill 26. The absorbent layer 19 can be saturated with the spill.

Embodiment 40 functions in a similar manner as described for embodiment 110 except that this device 40 is designed for use on carpet spills or spills on stone or terrazo floors. In this instance, device 40 is placed over the spill and activated by the force of one"s foot. This simultaneously activates the sachets 20 and 22 as well as sachet 34 which contains the stain remover.

Embodiments 50 and 60 function in a similar manner as previously described for embodiment 10. In embodiment 50, the two sachets 54 and 55 are similar to sachets 20 and 22 and when fractured result in carbon dioxide gas which fills balloon 52. This inflated balloon 52 assumes a position indicated in FIG. 7. Balloon 52 is connected to base member 17 such as at 70. It is also preferably connected to outer member 12 such as at 71 and 72, but such connections are not necessary.

Embodiment 60 is activated by fracturing the water sachet 64 which is composed of breachable polypropylene. The water causes the sponge 62 to expand to the position shown in FIG. 9. In this instance, the sponge 62 is connected to the sachet 64 which in turn is connected to the base member 17. The sponge 62 is preferably an open cell compressed cellulose material.

The inflatable member 80 and expandable member 81 function in the same manner as previously described for inflatable member 14 and expandable member 16. When the inner sachet 84 is breached, the water mixes with the powder 88 to form a gas and fill sachet 82 or expandable member 81. The gas escapes through pin hole 91 and fills inflatable member 80 to thereby cause the outer member 12 to erect. In order to deflate the inflatable member 80, it is torn open along the precut or weakened portion 92.

Figure 13:
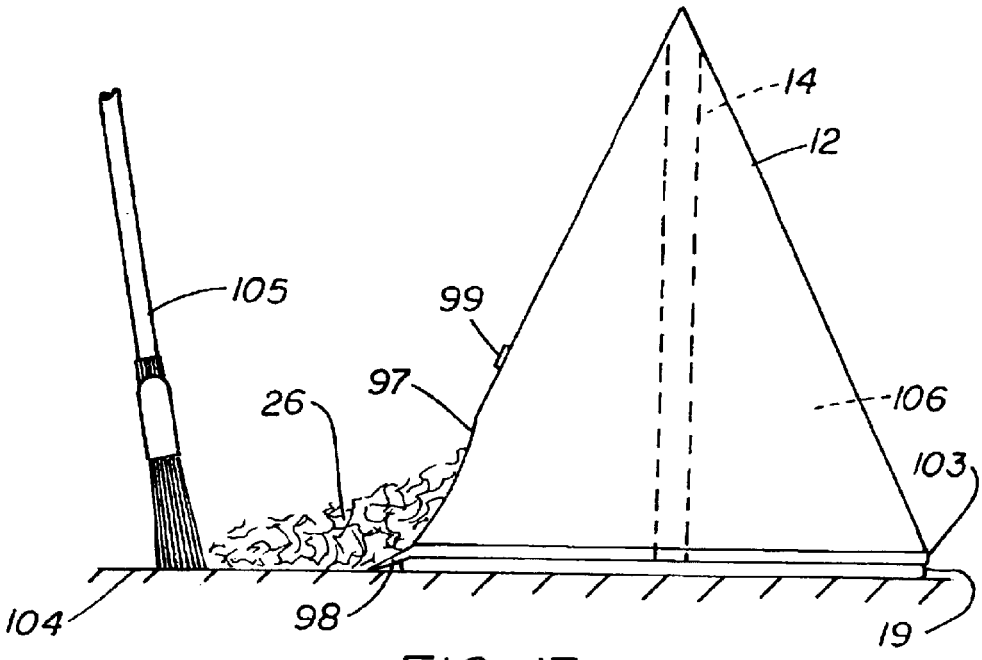
FIG. 13 is a side view of the device shown in FIG. 12 illustrating a function of the device.

Embodiment 100 also functions in the same manner as previously described for self erecting device 10. The difference is that opening 97 and lip 98 provide a dust pan function. As seen in FIG. 13, debris such as broken glass on floor 104 is swept over lip 98 and into opening 97 by the broom. It will be deposited in the cavity 106 afforded by the tent structure of signal member 12. In the event the spill also includes liquid material, it will be absorbed by the absorbent mat 19. With the debris placed in cavity 106, flexible signal member can be carried away such as by the handle 99, folded up, and disposed of.

Accordingly, embodiment 100 is a multifunction device. It functions as a signal device; a depositor for debris as well as a disposal member.

Embodiment 110 functions in the same manner as previously described for embodiment 100. The difference is that without the handle 99 as in embodiment 100, the user simply picks up the unit by the apex of the conical section 112. This allows the base pad 19 to sag, thereby keeping the collected debris from spilling out.

Figure 5:
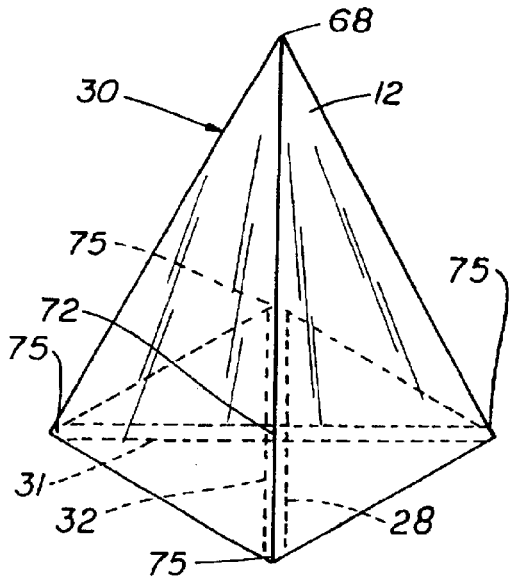
FIG. 5 is a view similar to FIG. 2 showing another embodiment.

The self-erecting devices 10, 40, 50 and 60, have all been described with an absorbent base member 17 or pad 19. If desired, this can be eliminated so the self-erecting feature is provided for a warning device as shown in FIG. 5 with embodiment 30. In place of base member 17, there is provided two cross members 31 and 32 which are connected at their centers such as at 72. Outer member 12 is in turn connected at four positions 75 to the cross members 31 and 32. The preferred material for composing cross members 31 and 32 is rigid paperboard. Although not shown in embodiment 30, it will include the same inflatable member 14 which will be connected to the cross members 31 and 32 such as at 72 as well as inside peak 68.

It will thus be seen that there is now provided a self-erecting device which is simple in construction as well as fast and efficient to operate. The self-erecting device provides a combined cleaning and signal apparatus which is adaptable to a wide variety of spill conditions. The absorbent layer 19 can be customized to particular facilities to accommodate the particular products being handled.

The preferred system for creating carbon dioxide gas for inflating the inflatable member 14 in embodiment 10 is water and sodium bisulfate and sodium carbonate powder. Alternatively, other systems could be employed such as the following acids: hydrochloric acid, nitric acid, sulfuric acid, citric phosphoric acid, acetic acid, lactic acid, glycolic acid, sulfamic acid, formic acid or other water soluble organic or inorganic acids, as well as sodium bisulfite, or mixtures thereof which react with one or more of the following: lithium carbonate, lithium bicarbonate, sodium sesquicarbonate sodium carbonate, sodium bicarbonate, potassium carbonate, potassium bicarbonate, ammonium carbonate, ammonium bicarbonate, magnesium carbonate, calcium carbonate or other bicarbonates or carbonates, or mixtures thereof.

Certain preferred plastic materials for fabricating the outer member 12, inflatable member 14, sachets 20, 22, 54, 55, 64 and pad 34 have been previously indicated. However, other materials could be employed such as the outer member 12 could be low-density polyethylene, polypropylene, polyamide, woven or nonwoven cotton or synthetic fabric, paper, foil, or other materials capable of being formed into flexible sheets. The inflatable members 14 and 80 could be low-density polyethylene, high-density polyethylene, vinyl, nylon (polyamide), natural or synthetic rubber or other materials capable of being formed into a flexible, sealable tube which can then hold pressure upon inflation. The breakable sachets 20, 22, 54, 55, 64 and pad 34 could be low-density polyethylene, high-density polyethylene, vinyl, nylon (polyamide), and foil or foil laminates thereof or other materials capable of holding liquids with minimal permeation through the film. Sachets 82 and 84 could also be composed of the previously indicated materials other than polyethylene. A certain preferred nonwoven fabric has been previously indicated for covering 18. Other fabrics such as a nonwoven fabric comprised of cellulose and/or polypropylene or polyethylene, heavyweight paper, or polymer reinforced paper can be used. In the instance of covering 18*a*, other materials such as a nonwoven or woven fabric or a liquid impervious layer such as aluminum foil, sheet polyethylene or propylene, could be employed. While a preferred material has been indicated for absorbent layer 19, other materials could be employed such as polypropylene or polyethylene fibers, cellulosic fibers, wood flour, sawdust, ground dried corncob, diatomaceous earth, ground pumice, dried clay, cat litter, vermiculite, synthetic clay, fumed silica, fuller"s earth, or similar functional materials. Cross members 31 and 32 are composed of rigid paperboard. However, other materials could be employed such as wood, metal, corrugated paperboard or any moldable plastic or plastic composites with sufficient thickness and strength to form a semi-rigid base. While certain preferred stain removers having been previously indicated for certain stains, others can be used such as combinations of detergents, builders, chelating agents, or solvents.

Support 103 and lip 98 are described as being composed of polyvinyl chloride. Other materials could be employed, such as polystyrene, polyethylene, polypropylene or other plastics, thin gauge metals such as aluminum or galvanized sheet steel, or paperboard, both coated and uncoated.

The unique self-erecting device has been described for use with spills. If desired, it can be employed in conjunction with any slippery condition such as wet mopped floors to signal a slippery condition.

What is claimed is:

1. A self-erecting and debris collecting device comprising:

a base member constructed to rest on a surface;

a gas generating member;

an inflatable member in fluid communication with the gas generating element; and a signal member which is erected by the inflatable member, the signal member constructed and arranged to provide a receptacle for debris.

2. A device of claim 1 wherein the inflatable member is in the signal member.

3. A device of claim 1 wherein the signal member is connected to the inflatable member.

4. A device of claim 1 wherein the signal member is a flexible, expandable, pyramidal blanket overlying the base member.

5. A device of claim 1 wherein the base member includes a liquid absorbent material.

6. A device of claim 1 wherein the gas generating member includes a sachet of dry gas generating powders and a sachet of water.

7. A device of claim 1 wherein the signal member is connected to the base member and an apex of the inflatable member and rises over the base member on inflation of the inflatable member.

8. The device of claim 1 wherein the receptacle includes an opening extending over a portion of the base member.

9. The device of claim 8 wherein the base member includes a beveled edge positioned adjacent the opening.

10. The device of claim 1 wherein the signal member includes a handle.

11. The device of claim 1 wherein the signal member is expanded to a pyramidal configuration.

12. A self-erecting and debris collecting device comprising:

a signal member, the signal member constructed and arranged to provide a receptacle for debris;

an inflatable member, the signal member connected to the inflatable member;

a self-contained expandable member, the inflatable member constructed and arranged to be inflated by the self-contained expandable member; and a base member, the inflatable member connected to the base member.

13. The device of claim 12 wherein the base member includes an absorbent member constructed and arranged to absorb liquid and spills on a surface.

14. The device of claim 12 wherein the expandable member includes an expandable system comprised of a liquid and an expandable member which expands when contacted with the liquid, the liquid and expandable members being separated by a breachable member to provide contact between the liquid and the expandable member.

15. The device of claim 14 wherein the liquid is water and the expandable member is a sponge.

16. The device of claim 12 wherein the expandable member includes water and a first material and second material which when mixed with the water react to produce a gas, the materials being separated by a breachable member.

17. The device of claim 16 wherein the inflatable member is comprised of a gas impervious flexible material.

18. The device of claim 16 wherein the inflatable member is a latex balloon.

19. The self-erecting device as defined in claim 16 wherein the inflatable member comprises gas impervious material and wherein the inflatable member has a tubular configuration when inflated.

20. The device of claim 19 wherein the signal member includes warning indicia.

21. A method of cleaning up a spill and debris on a floor while signaling the spill employing the device of claim 1.

22. A method of cleaning up a spill and debris on a floor while signaling its location employing the device of claim 12.

* * * * *